United States Patent [19]

Simon

[11] 4,303,084

[45] Dec. 1, 1981

[54] SELF-EXTINGUISHING CIGARETTES

[76] Inventor: Eli Simon, 7175 Little Harbor Dr., Huntington Beach, Calif. 92648

[21] Appl. No.: 168,122

[22] Filed: Jul. 14, 1980

[51] Int. Cl.[3] ..... A24D 1/02; A24D 1/10; A24D 1/12

[52] U.S. Cl. ..... 131/349

[58] Field of Search ..... 131/349, 362, 355, 358, 131/365

[56] References Cited

U.S. PATENT DOCUMENTS

| | | | |
|---|---|---|---|
| 2,985,175 | 5/1961 | Rich | 131/349 |
| 3,030,963 | 4/1962 | Cohn | 131/349 |
| 4,044,778 | 8/1977 | Cohn | 131/349 |
| 4,187,862 | 2/1980 | Cohn | 131/349 |

*Primary Examiner*—V. Millin

[57] ABSTRACT

This invention concerns the use of a class of coatings that are applied to the paper wrapper that encloses the cigarette's smoking medium, for limiting in a predictable manner the free burning time of the treated cigarette, or controlling the lapsed time prior to self-extinguishment after being lit and left unattended. The coating materials are generally identified as polymeric chlorine-containing film-forming latexes that cure at ambient temperature, forming flexible, water-resistant, flame-retardant deposits. Comparable results are obtained, for equivalent weight percentages of the deposited latex solids, by either pre-coating the portion of paper wrapper that encloses the charge of tobacco or smoking medium or by post-treatment of the external surface of the assembled cigarette. For cigarettes having paper wrappers coated to contain 19±6 weight percent latex solids of this invention, based on the weight of the treated paper that encloses the smoking medium, after being lit and left unattended a self-extinguishing time of from 1 to 3 minutes can be expected, meeting a practicable compromise for the smoker between safety and smoking convenience.

4 Claims, No Drawings

SELF-EXTINGUISHING CIGARETTES

BACKGROUND

In my recent U.S. Pat. No. 4,230,131, titled Self-Extinguishing Cigarettes, I discussed the rationale' for the need that lit cigarettes have a limited, controlled free-burning time. The time period of 1 to 3 minutes selected for self-extinguishment was predicated on a condition believed acceptable to the smoker without however sacrificing the objective of reducing the probability of fires caused by smoldering cigarettes inadvertently dropped onto combustible materials such as bedding and overstuffed furniture. In this invention, I disclose the use of an additive system other than those of boric acid, benzenephosphonic acid and the aqueous reaction product between 2-moles of benzenephosphonic acid and 1- mol of melamine noted in the referenced patent, and more specifically the application of certain chlorine-containing copolymer latexes to the cigarette's paper wrapper. The resultant coatings have the characteristics of flexibility, water-resistance, and storage-stability, so that the paper subsequent to be used to enclose the tobacco charge or smoking medium can be pre-treated if desired to the extent within the limits specified; pretreatment in contrast to post-treatment avoids paper staining by aqueous mixtures of flame-retardants while only minimally interrupting the normal cigarette production process.

SUMMARY OF THE INVENTION

Application of the latexes of this invention to the cigarette paper wrapper, either prior or subsequent to enclosing the tobacco or smoking medium charge, is capable of imparting to the cigarette a controllably limited free burning time after it is lit and left unattended. In the absence of a forced intake of air, factors involved in the self-extinguishment mechanism appear related to the observed substantially reduced rate-of-burn of the coated cigarette as compared to that for the uncoated Control, and to an apparently reduced temperature of the burning front beneath the ash.

The film properties of the disclosed carboxylated vinylidene chloride- butadiene copolymer latexes are such that the cigarette paper wrapper can be pre-treated, stored, and otherwise managed in accordance with conventional practices; coating treatment however may be delayed until after the smoking medium is enclosed. For the purposes of esthetics, quality control with regard to the weight percent of the deposited flame-retardant, and compatibility with manufacturing practices, the method of pre-treatment is the preferred choice.

In determining the burning characteristics of lit and unattended cigarettes, the testing conditions were uniformly controlled, namely: the lit cigarettes were supported with the burning end free of physical contact in an upward position of 30° from the horizontal, and augmented air movement was provided from a wall-mounted forced air unit; the time of expiration was taken when there was no visible emission of smoke and the cigarette could not be "re-ignited" by the drawing-in of air.

The free burning time of the cigarette, or the lapsed time between lighting and self-extinguishment, is adjusted to be within the range of one to three minutes, providing a reasonable continuity-of-burning to the smoker while meeting the need for a reduced smoldering time when lit and inadvertently left unattended; this adjustment in time is made by controlling the weight percent of the coating deposited by the carboxylated vinylidene chloride-butadiene copolymer latex within $19 \pm 6$ based on the treated total weight of paper wrapper enclosing the smoking medium.

Coating of the paper wrapper to limit the free burning time of the cigarette does not appear to significantly affect the quantity of the effluent products of combustion transferred through the filter tip, as indicated by comparing the ambient temperature condensibles of treated cigarettes with uncoated filter tip Controls; in this test, the weight differential of cotton absorbers is quantitatively obtained after heating for 15 minutes at 100° C. prior to each weighing, and is identified as "net passed catch" in the related example that is presented later.

DESCRIPTION OF THE INVENTION

Self-extinguishment of lit cigarettes when left unattended is accomplished by coating the paper wrapper with selected latexes; the adjustment of the "free" combustion time period is controlled by the weight percent of the deposited latex solids, based on the total weight of that portion of the treated paper that encloses the charge of tobacco or smoking medium.

The latexes of this disclosure readily cure at an ambient temperature of approximately 20° C. to form soft, flexible, water-resistant films that are intrinsically flame-retardant. The polymeric structure of the latex is identified as a carboxylated vinylidene chloride-butadiene copolymer system, as noted by the Dow Chemical Company in their bulletin "Dow Carboxylated Vinylidene Chloride-Butadiene Latex for Adhesives," published in 1975; in particular, as the example in subsequent discussions, Dow XD-30208.01 is cited as illustrative of this general class of latexes. For ease of application and improvement in the control of the weight percent of the deposited film, the latex, nominally at a solids content of 48%, is diluted with a distilled-grade of water to about 10 to 15 weight percent solids, although the exact solids content should not be construed as defining or limiting the scope of the invention. Other reported physical properties of Dow's XD-30208.01 are a chlorine content of 36%, a particle size of 1400 A° and a pH of 8.0.

For equivalent coating weight percentages of the paper wrapper, comparable self-extinguishing times are obtained by both methods of treatment, namely, pre-treatment of the paper wrapper prior to its enclosing the smoking medium and post-treatment of the assembled cigarette. The method of pre-treatment is preferred as it avoids the possibility of staining of the paper wrapper by the wetted tobacco, and is more compatible with current manufacturing practices.

To demonstrate the significance of intrinsic flame-retardency for the deposited polymeric film, comparison with a similar latex but lacking that property showed it to be ineffective in limiting the free-burning time of a cigarette, lit and left unattended.

To determine whether the coatings deposited by Dow's XD-30208.01 latex, within the weight percent range specified in this disclosure, adversely affects the quantity of effluents from a lit cigarette, comparison of the ambient temperature condensible products was made by smoking the cigarettes in a vertical position using as "draw" a simulated smoking device at a constant vacuum differential of 2" water. The products of combustion were caught downstream of the filter tip by pre-weighed cotton plugs of 0.400 g. each, and the net increase in weight of the absorbers after heating for 15 minutes at 100° C. before and after smoking is termed the "net passed catch;" this is believed to be an important parameter as it reflects the quantity of combustion by-products that the smoker could inhale, in excess of that retained by the filter tip.

These and other aspects of the invention will be discussed, expanded on, and defined further in the examples set forth.

EXAMPLES OF THE INVENTION

EXAMPLE 1

In this example aqueous-diluted mixtures of Dow Chemical Company's carboxylated vinylidene chloride-butadiene copolymer latex (XD-30208.01) were used to coat the paper wrappers (exclusive of the filter tips) of Carlton 100's cigarettes from which the enclosed charge of tobacco had first been removed. After ambient temperature drying of approximately 20° C., the weight of the latex-deposited coatings were determined from which its weight percent of the treated paper wrapper was calculated; the coated, cylindrically-intact, paper wrapper housings were then repacked with the same charges of tobacco previously removed, and the burning characteristics at the outer, center, and inner sections of each of the cigarettes obtained after being lit and left unattended. Observations and results are given in Table I with regard to paper wrapper appearance and the self-extinguishing behavior; additional comments relating to the effect of the coating on "draw" during normal smoking, and the solid contents of Dow's XD-30208.01 latex used to obtain the various coating weight percentages is given in the "notes" following.

TABLE I

Coating Weight Percent Variations, Based on Treated Paper Wrapper Weight, Using Dow XD-30208.01 Latex, and Their Effects

| Wt. % of XD-30209.01 Solids | Physical Characteristics and Appearance of the Coated Paper Wrappers | Burning Evaluation of Paper Wrapper-treated Cigarettes, After Being Lit & Unattended |
|---|---|---|
| 7.8 to 9.8 | No adverse effects; paper dry, flexible, and with matte appearance. | Did not self-extinguish, ie., continued to burn for more than 3 minutes. |
| 13.5 to 17.7 | Paper dry and flexible; other than slight increase in gloss, no significant change. | Each of the three sections self-extinguished in approximately 2 minutes. |
| 19.0 to 26.1 | Paper semi-glossy, non-tacky, & flexible; tear-strength and handling similar to Control. | Each of the three sections self-extinguished in approximately 2 minutes. |
| 30 to 35 | Very slight surface tack; flexible & glossy. | Each of the three sections self-extinguished in approximately 2 minutes. |
| 40 to 45 | Slight surface tack; flexible & glossy. | Each of the three sections self-extinguished in approximately 2 minutes. |

Notes (to Table I)

(1) For the 7.8 to 9.8 wt. % range of coated paper, a 5% solids content of Dow's XD-30208.01 (latex) was used; for the 13.5 to 17.7 wt. % range, a 10% solids content latex was used; for the 19.0 to 26.1 wt. % range, a 15% solids content latex was used; for the 30 to 35 wt. % range, a 20% solids content latex was used; and for the 40 to 45 wt. % range, a 25% solids content latex was used.

(2) The minimum coating weight percent range for self-extinguishment within 3 minutes appears to be between approximately 10 to 13; significantly, increasing the coating weight percent in excess of the selected range of 19 ± had only a minor effect on the free burning time while, at the same time, having other characteristics that decrease the efficacy of the invention.

(3) For coating weight percentages in excess of approximately 25, the "draw" becomes more difficult, due perhaps to the decreased porosity of the paper; also, above coating weight percentages of approximately 30, there is an increase in gloss and surface tack, both of which would be deterrents to acceptability.

(4) Self-extinguishing compositions showed a markedly reduced rate-of-burn.

(5) The Dow XD-30208.01 latex coating modifies both the taste and odor of lit cigarettes, although within the range of 19 ± 6 weight percent these alteration in properties did not appear objectionable. As exploratory, offsetting masking agents were considered; of these, mentholating the filter tip and including small percentages of reodorants in the latex coating mixture were useful.

EXAMPLE 2

In this example, the requirement for intrinsic flame-retardency of the latex coating is demonstrated if self-extinguishment of a lit cigarette is to be obtained. Dow Chemical Company's 221-A latex (a carboxylated styrenebutadiene copolymer), that for the exception of flammability of its deposited film is similar in application and coating characteristics to Dow's XD-30208.01, was diluted with distilled water from its nominally packaged 43 weight percent solids to 15 weight percent solids and used to separately treat paper wrappers (as in Example 1) to an ambient-dried averaged weight percent of approximately 20. After repacking with the original charge of tobacco and smoking in a normal manner, they continued to burn when left unattended; that is, they did not self-extinguish within a time period of 3 minutes.

It is apparent that flame-retardants such as those of boric acid, the borates, the ammonium phosphates, urea phosphates, etc., can be added to a latex such as Dow's 221-A to reduce the flammability of the deposited film. This approach to compensate for its lack of intrinsic flame-retardency detracts from the simplicity, novelty, and adequacy of my concept for providing a stable, water-resistant coating with minimal change in the physical properties of the paper wrapper which in the treated state, is capable of being stored and used on demand.

EXAMPLE 3

In this example, correspondance is shown between postcoating that portion of the paper wrapper that already encloses a charge of tobacco as compared to its being separately treated as in Example 1. For single brush coats of a 10 wt.% mixture of Dow's XD-30208.01 latex solids applied to Carlton 100's, a deposited weight percent (based on the total weight of that portion of the paper treated) varied from approximately 14 to 18, closely equivalent in values to those previously given for the separated paper wrapper housings. After being lit and left unattended, all self-extinguished within 1½ to 2 minutes, showing an acceptable performance relationship for the two methods of latex application.

EXAMPLE 4

In this example (the results of which are given in Table II), the general applicability of the invention is shown by applying uniformly controlled treatments to several different brand names of cigarettes. The paper wrappers that enclosed the charges of smoking mediums were coated with aqueous-diluted Dow Chemical Company's XD-30208.01 latex so as to deposit averages each of about 15 and 22 weight percent of the latex polymer solids, based on the weight of the treated portion of the paper wrapper. After ambient temperature drying (of about 20° C.), the cigarettes were evaluated for self-extinguishment capability by the procedure previously described. The identification of the cigarette brands (noted in Table II as a,b, etc.) is given under "note 1", following.

TABLE II

Evaluation, General Applicability of Dow XD-30208.01 Latex for Self-Extinguishing Capablility of Cigarettes

| Cig.no. | Time To Self-Extinguish(note 3) | |
|---|---|---|
| (note 1) | 15 wt. % avg. Latex Solids | 20 wt. % avg. Latex Solids |
| a | 2 minutes, average | ½ to 2 minutes |
| b | 2 min. avg., with and without mentholated tip | 1½ to 2 min. with and without mentholated tip |
| c | 2 minutes, average | 1½ to 2 minutes |
| d | 2 minutes, average | 1½ to 2 minutes |
| e | 2 minutes, average | 1½ to 2 minutes |
| f | 2 minutes, average | 1½ to 2 minutes |
| g | 2 minutes, average | 1½ to 2 minutes |
| h | approximately | approximately |
| (note 2) | 3 minutes | 3 minutes |

Note 1- Cigarette (filter tip) Nomenclature
#a Golden Lights (Lorillard)
#b True (Lorillard)
#c Real (R.J. Reynolds Tobacco Co.)
#d Now (R.J. Reynolds Tobacco Co.)
#e Vantage (R.J. Reynolds Tobacco Co.)
#f More (R.J. Reynolds Tobacco Co.)
#g L & M Long Lights (Liggett Group, Inc.)
#h Free (International Brands Inc.)
Note 2
The smoking medium of #h (or "Free") is of non-tobacco origin and (according to International Brands Inc.) contains no nicotine.
Note 3
The burning rate for all of the treated cigarettes was greatly reduced. (see Example 5)

EXAMPLE 5

Information on the rate-of-burn for lit cigarettes is presented in Table III, as a partial continuation of Ex.4 but with emphasis on more directly identifying the reduction of burning rate for the coated cigarettes. Additionally, inferred as concomitant to the self-extinguishing characteristic, is the reduction of ash temperature of a burning cigarette (that accompanies the reduced rate-of-burn).

TABLE III

Rate-Of-Burn Of Lit Cigarettes

| Cigarette Information | Burning Characteristics | Burning Time/Cigarette (complete or extrapolated) |
|---|---|---|
| Uncoated "Free" ref., #h,Ex.4 | Does not self-extinguish | Approximately 8 minutes for complete burn of 50 mm. |
| Coated "Free" #h, Ex. 4 | Self-extinguished in about 3 minutes | 30 minutes (extrapolated for a 50 mm burn). |
| Carlton 100 uncoated | Does not self-extinguish | Approximately 7½ min. for a burn length of 50 mm. |
| Carlton 100 treated(*) | Did not self-extinguish | Approximately 15 minutes for a 50 mm burn. |
| Carlton 100 treated(**) | Self-extinguished in 1½ to 2 min. | 30 minutes (extrapolated for a 50 mm burn). |

(*)8.5 wt. % XD-30208.01 solids of treated paper wrapper
(**)16 wt. % XD-30208.01 solids of treated paper wrapper

EXAMPLE 6

In this example, the quantities of ambient temperature condensible effluents from mechanically-smoked cigarettes are compared for uncoated and treated paper wrappers that enclose tobacco and non-tobacco smoking mediums; the results presented in Table IV were obtained in accordance with the procedure described under the section of this disclosure, titled "Description of Invention." For the tobacco-containing smoking medium, represented by Carlton 100's, there is no significant change attributable to the coating, applied to the paper wrapper within the limits specified for securing self-extinguishment. For the non-tobacco-containing cigarette, represented by Free (ref., #h, Ex.4), those treated to contain weight percentages comparable to the coated Carlton 100's showed a noticeable percentage increase in "effluents;" however, comparing equivalent burn lengths, ie., 65 mm, both of the treated cigarettes (Carlton 100's & Free) were approximately the same in their "net passed catches".

TABLE IV

Effluent Catch Tests

| Cigarette Identification and Treatment | Net Passed Catch (mechanical smoking at 2" water differential) |
|---|---|
| Carlton 100's - no treatment (Controls) 65 mm burn length | 9 mg., average |
| Carlton 100's - treated(15–20 wt. % XD-30208.01 latex solids) 65 mm. burn | 10 mg., average |
| Free - no treatment (ref., Ex.4) | 4 mg. avg., 50 mm. burn (5.2 mg., extrapolated to a 65 mm. burn) |
| Free- treated(15–20 Wt. % Dow's XD-30208.01 latex solids) | 6.7 mg. avg., 50 mm. burn (8.7 mg. extrapolated to a 65 mm. burn) |

I claim:

1. A self-extinguishing cigarette comprising a paper wrapper enclosing a charge of tobacco or smoking medium wherein a carboxylated vinylidene chloride-butadiene copolymer latex having a chlorine content of approximately 36% has been applied to the wrapper so as to be uniformly distributed in an amount effective so as to cause said cigarette to self-extinguish when lit and left unattended.

2. A self-extinguishing cigarette according to claim 1 in which the chlorine-containing copolymer latex applied to the paper wrapper enclosing the charge of tobacco or smoking medium comprises, after ambient temperature drying, 19±6 weight percent of the total weight of the paper wrapper treated.

3. A self-extinguishing cigarette according to claim 1 in which the chlorine-containing copolymer latex is uniformly applied to the paper wrapper enclosing the charge of tobacco or smoking medium in an amount to deposit, after ambient temperature drying, approximately 15 weight percent coating solids based on the total weight of the paper treated.

4. A self-extinguishing cigarette according to claim 1 in which the treated cigarettes self-extinguish within 1 to 3 minutes when lit and left unattended.

* * * * *